US005392626A

United States Patent [19]

Blezard et al.

[11] Patent Number: 5,392,626

[45] Date of Patent: Feb. 28, 1995

[54] FLEXIBLE HYDRAULIC EXPANSION MANDREL

[75] Inventors: Mark Blezard; Keirouz Diab, both of Cambridge, Canada

[73] Assignee: The Babcock & Wilcox Company, New Orleans, La.

[21] Appl. No.: 214,342

[22] Filed: Mar. 16, 1994

[51] Int. Cl.[6] ..... B21D 26/02

[52] U.S. Cl. ..... 72/62

[58] Field of Search ..... 72/58, 61, 62

[56] References Cited

U.S. PATENT DOCUMENTS 1,930,745 10/1933 Fisher ..... 72/62
2,966,740 1/1961 Macha et al. ..... 72/62
4,195,390 4/1980 Amen ..... 72/58
4,513,497 4/1985 Finch ..... 72/62
4,951,492 8/1990 Vogt ..... 72/61

*Primary Examiner*—David Jones
*Attorney, Agent, or Firm*—Daniel S. Kalka; Robert J. Edwards

[57] ABSTRACT

A flexible mandrel for expanding a tube in a tubesheet comprises a length of flexible wire which is placed within a tube. A hydraulic seal is located at each end of the length of flexible wire for sealing a section of the tube and is connected to the flexible wire by a connector. A fluid inlet is provided at the rear end of the mandrel for providing fluid to the mandrel between the sealed section of the tube.

6 Claims, 4 Drawing Sheets

FLEXIBLE HYDRAULIC EXPANSION MANDREL

BACKGROUND OF THE INVENTION

1. Field of the Invention

The present invention relates, in general, to heat exchanger tubes and, in particular, to a new and useful device for hydraulically expanding a tube within a tubesheet.

2. Description of the Related Art

In the power plant field, a tubesheet is used for a nuclear steam generator, heat exchanger or a similar component that houses several thousand tube ends. The tubesheet has numerous holes previously drilled in it which allows for each tube end to be inserted therethrough. The tube ends are welded to the tubesheet and circumferentially expanded into the tubesheet holes through virtually the full thickness of the tubesheet. This process is commonly referred to as full depth expansion.

The expansion of the tube ends can be achieved through mechanical or hydraulic processes. When manufacturing components for a nuclear steam generator, it is preferable that hydraulic expansion be used. Each tube is hydraulically expanded into its tube hole after welding so that the expansion closes the crevice between the tube and the hole in order to avoid a potential corrosion site.

Hydraulic expansion is the recommended method for nuclear steam generators because it produces less residual stress in the tube and reduces the potential for stress corrosion cracking compared to other expansion methods. The tube is expanded by inserting a probe. The expansion probe has a seal positioned at each end of the expansion zone. Distilled water at 35,000 psi (2413 bar) is pumped through the probe which expands the tube and seals it against the tube hole.

The expansion probe must be carefully positioned with respect to the secondary face of the tubesheet. If the probe is positioned beyond the face, then unacceptable tube deformation could occur. If the probe is too far inside the tube hole, an unacceptably long crevice could possibly result. Therefore, the tubesheet thickness variation is measured and the probe length is adjusted to ensure proper positioning.

In the central region of a tubesheet, the tubes are expanded using a one-step full depth hydraulic expansion mandrel. For those tubes located at the outer periphery of the tubesheet, a two-step hydraulic expansion technique is used to expand the tube ends due to possible interference with the hemispherical head.

Presently, there is no known device which can be utilized to expand a tube end over the entire tubesheet including peripheral areas.

SUMMARY OF THE INVENTION

The present invention pertains to the expansion of tube ends extended through tubesheets.

The present invention is a mandrel for expanding a tube end comprising a length of flexible wire which is placed within a tube end. Hydraulic seals are located at each end of the length of flexible wire for sealing a section of the tube end. Each hydraulic seal is connected to the flexible wire by a steel connector. A hydraulic fluid inlet is provided at one end of the mandrel for providing fluid between the seals for expanding the section of tube.

It is an object of the present invention to provide a mandrel for expanding a tube end which is easy to use, simple to manufacture and rugged in construction.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

DESCRIPTION OF THE PREFERRED EMBODIMENT

Figure 1:
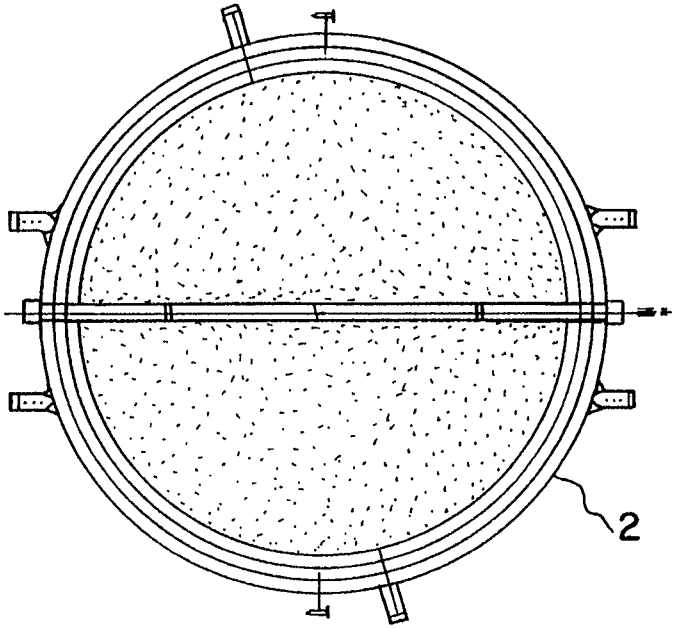
FIG. 1 is a plan view of a tubesheet.
Figure 2:
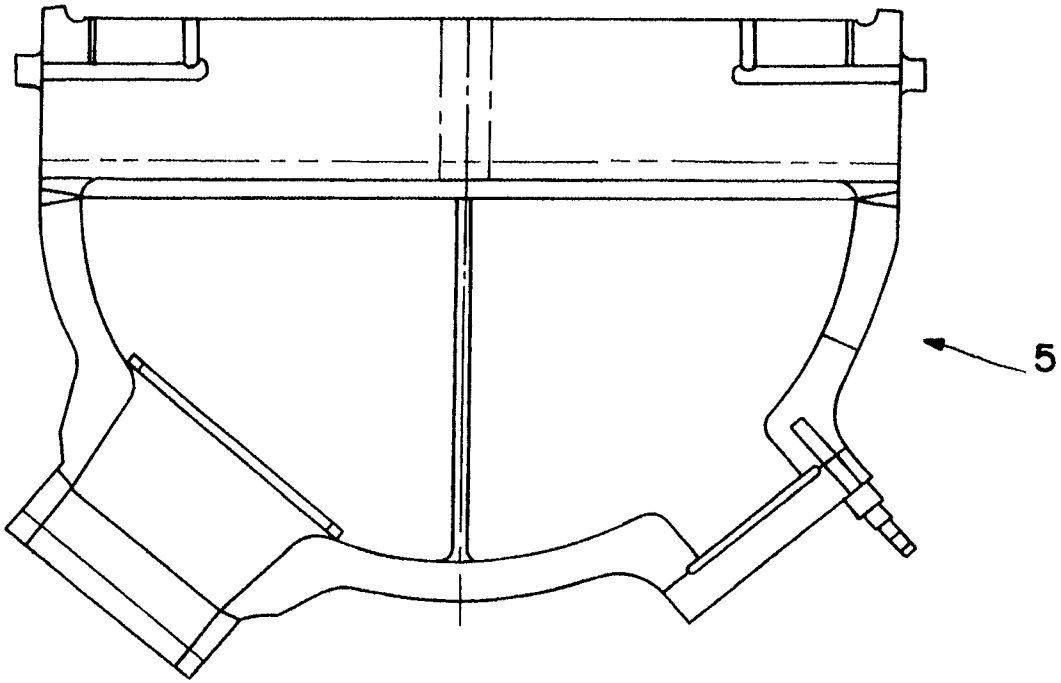
FIG. 2 is a schematic view illustrating a hemispherical head.
Figure 3:
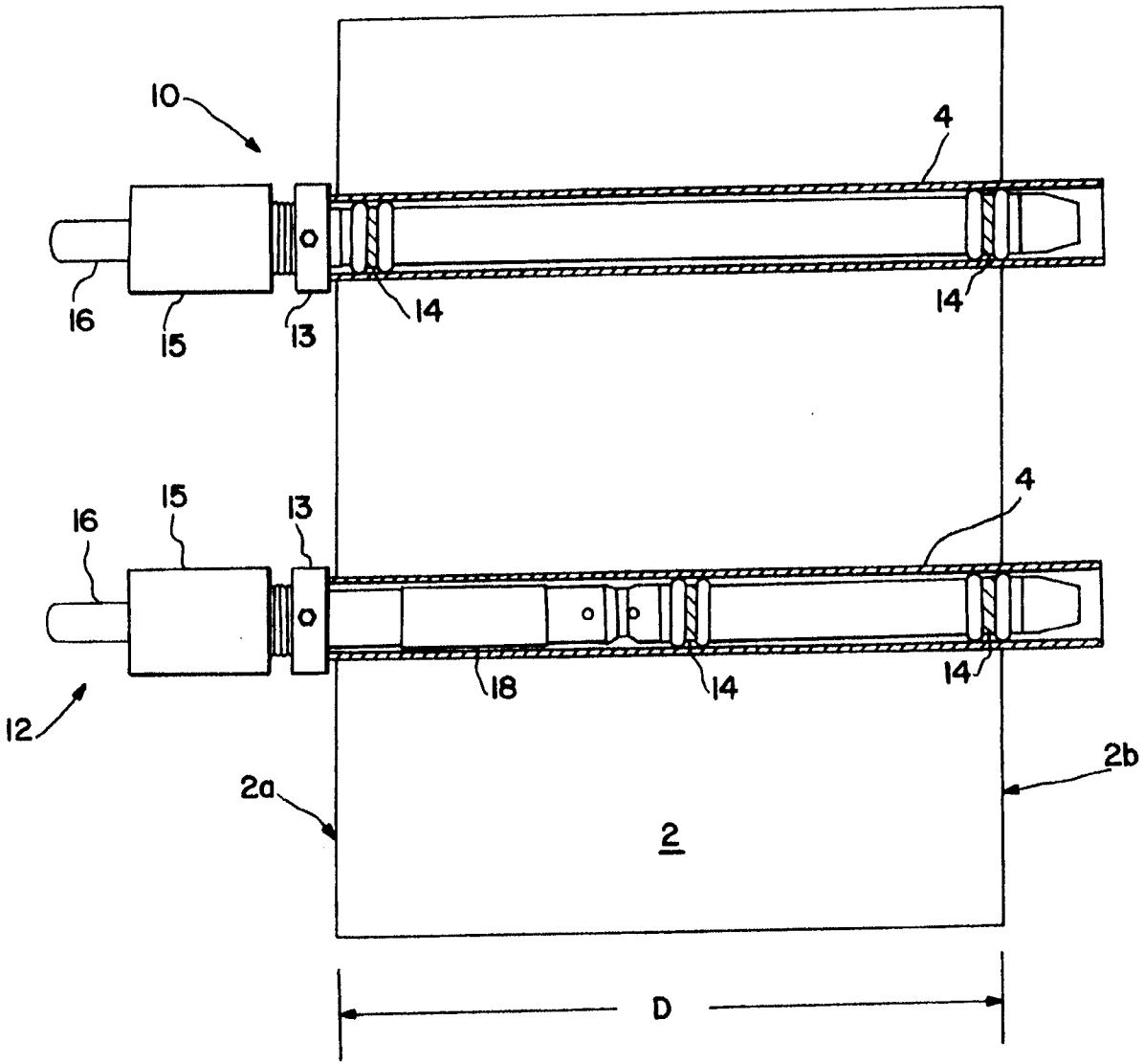
FIG. 3 PRIOR ART
FIG. 3 is a schematic view illustrating a tubesheet having a known one-step full depth expansion mandrel and a known two-step expansion mandrel.

As shown in FIG. 3, tubes 4 which are located in a tubesheet 2 (FIG. 1) are expanded through the use of a known one-step full depth expansion mandrel 10 for those tubes which are located in a central portion of the tubesheet 2. For those tubes 4 located near the periphery of tubesheet 2, a known two-step expandable mandrel 12 is used[to expand the tubes 4 because of the curvature of the hemispherical head 5 (FIG. 2), encroaches on the probe insertion area.

The known one-step expansion mandrel 10 has hydraulic seals 14 at each end of the probe. Mandrels 10 and 12 utilize a calibration collar 13 in conjunction with a handle 15 and a pressure tube 16 for providing fluid to the tube 4 for expanding the tube 4 to correspond to a thickness D of the tubesheet 2.

The two-step expandable mandrel 12 has hydraulic seals 14 spaced apart from each other; and a flexible extension 18, which is a flexible hose, attached at one end of the probe 12. The two-step expandable mandrel 12 is a half-length mandrel which is inserted at a primary side 2*a* of the tubesheet 2 and is extended through the tube 4 until it reaches a set position relative to a secondary side 2*b* of the tubesheet 2. The two-step mandrel 12 allows for half of the length of the tube 4 to be hydraulically expanded. After expanding half of tube 4, the half-length mandrel 12 is extracted from the tube 4. A second two-step expandable mandrel 12 is then inserted into tube 4 at primary side 2*a* of tubesheet 2 in order to expand the remaining portion of the tube 4 contained within the tubesheet 2.

It is been estimated that for steam generators, approximately 20% of all tubes require a two-step expansion. Because of this two-step requirement, the procedure described above using the two-step expandable mandrel 12 requires a significant amount of labor and cost.

Figure 4:
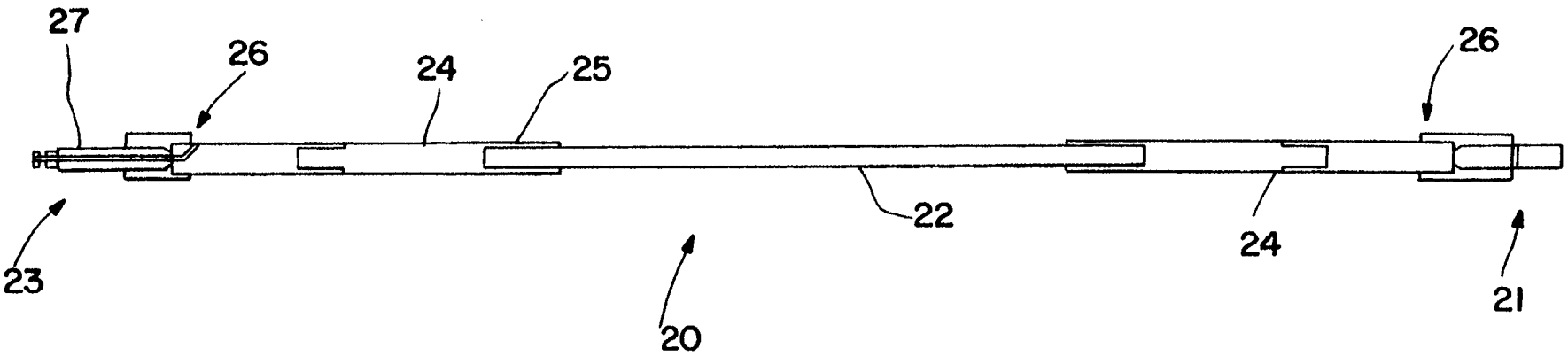
FIG. 4 is a schematic view illustrating the present invention.

According to the present invention, as shown in FIG. 4, a flexible hydraulic expansion mandrel 20 is used for all tube ends at all areas of a tubesheet. The mandrel 20 comprises a flexible wire 22, such as a cable or wire rope, which is placed within a tube 4 (FIG. 3) for expanding the tube 4 according to the tubesheet thickness D. A connector or joint 24, which is steel, connects a hydraulic seal 26 to each end of the flexible wire 22. The connection between connector 24 and flexible wire 22 is a cable to steel transition joint 25.

A fluid inlet 27 is provided at a rear end 23 of the mandrel 20 opposite a front end 21. The fluid provided through fluid inlet 27 is provided between hydraulic seals 26 for expanding the tube 4 (FIG. 3).

While specific embodiments of the invention have been shown and described in detail to illustrate the application of the principles of the invention, it will be understood that the invention may be embodied otherwise without departing from such principles.

We claim:

1. A flexible mandrel for expanding a tube in a tubesheet of a steam generator, the mandrel comprising:

a length of flexible wire for being placed within a tube inside a tube sheet of a steam generator;

sealing means at each end of the length of flexible wire for sealing a section of the tube;

a connector at each end of said flexible wire for connecting the sealing means to the length of flexible wire; and a single fluid inlet at one end of the mandrel for providing fluid into the section of the tube for sealing and expanding the tube within the tube sheet.

2. The mandrel according to claim 1, wherein the flexible wire is a cable.

3. The mandrel according to claim 1, wherein the flexible wire is a wire rope.

4. The mandrel according to claim 1, wherein the sealing means comprises a hydraulic seal.

5. The mandrel according to claim 1, wherein the connector is made of steel.

6. The mandrel according to claim 1, wherein the one end of the mandrel is a rear end of the mandrel.

* * * * *